United States Patent [19]

Hino et al.

[11] Patent Number: 4,499,888

[45] Date of Patent: Feb. 19, 1985

[54] IGNITION SYSTEM FOR INTERNAL COMBUSTION ENGINE

[75] Inventors: Toshiyuki Hino; Katsuyoshi Masuno, both of Hyogo, Japan

[73] Assignee: Mitsubishi Denki Kabushiki Kaisha, Tokyo, Japan

[21] Appl. No.: 427,099

[22] Filed: Sep. 29, 1982

[30] Foreign Application Priority Data

Oct. 1, 1981 [JP] Japan ..... 56-146935[U]

[51] Int. Cl.[3] ..... F02D 7/00

[52] U.S. Cl. ..... 123/615; 123/196.5 A; 123/647

[58] Field of Search ..... 123/647, 146.5 A, 615

[56] References Cited

U.S. PATENT DOCUMENTS 4,126,112 11/1978 Tershak ..... 123/615 X 4,307,698 12/1981 Yoshinari ..... 123/647

4,315,493 2/1982 Onishi et al. ..... 123/146.5 A X

*Primary Examiner*—Tony M. Argenbright

*Attorney, Agent, or Firm*—Sughrue, Mion, Zinn, Macpeak, and Seas

[57] ABSTRACT

An ignition system includes a signal generator unit 1 comprising a sensor core/coil, and an electronic circuit unit 2 including various components mounted on a substrate board. Both units are accommodated within a unitary casing comprising a frame 5 and a heat sink 10 on which the board is mounted. The casing has an open end or face in which the core is mounted in proximity to an engine driven rotor. The interconnecting leads between the coil and substrate board include terminal plates 6 and short straps 7 to avoid spurious high frequency radiations and induced signals.

6 Claims, 11 Drawing Figures

ROTOR PROJECTION OPPOSITE CORE
NO PROJECTION OPPOSITE CORE

DETECTOR THRESHOLD

0

0

0

0

IGNITION SYSTEM FOR INTERNAL COMBUSTION ENGINE

BACKGROUND OF THE INVENTION

The present invention relates to an ignition system for internal combustion engines which detects ignition timing in response to a variation in the condition of oscillation of a resonant circuit composed of a capacitor and a coil which is wound around a core disposed in confronting relation to a signal rotor.

SUMMARY OF THE INVENTION

It is an object of this invention to provide an ignition system which eliminates lengthy interconnecting leads in which spurious ignition pulses may be induced and which themselves generate radio frequency interference signals, as in the prior art. This object is attained in a mechanically reliable, small and lightweight ignition system arranged such that a signal generator unit and an electronic circuit unit are housed and wired within a unitary casing having one end open.

DETAILED DESCRIPTION OF THE PREFERRED EMBODIMENT

Figure 1:
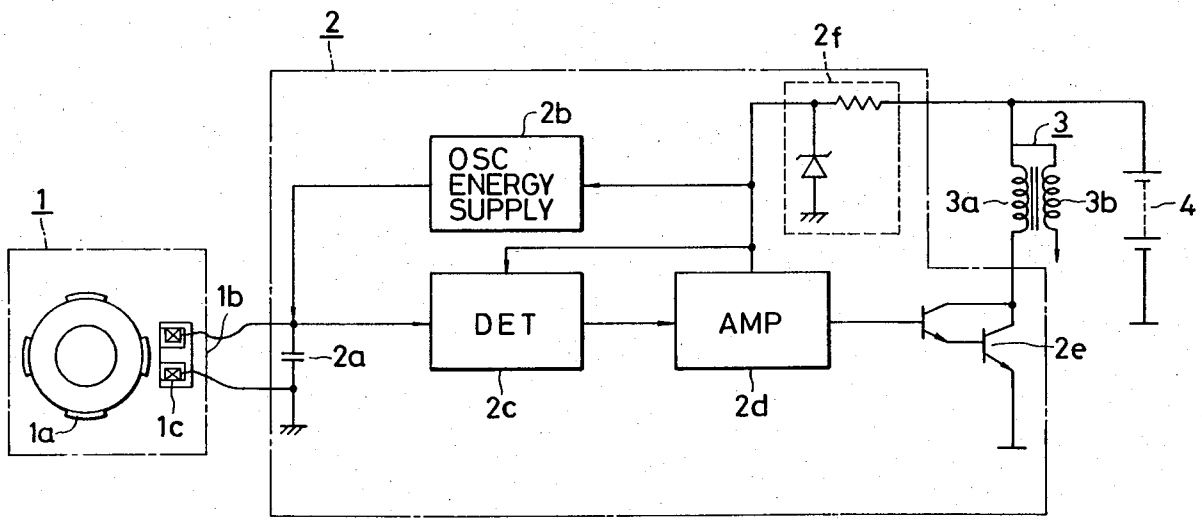
FIG. 1 shows a block diagram of an ignition system for an internal combustion engine, FIGS. 2(*a*) through 2(*e*) show waveform diagrams generated during the operation of the system of FIG. 1.

Referring to FIG. 1, a signal generator unit 1 mounted in a distributor (not shown) comprises a signal rotor 1*a* driven in synchronism with an internal combustion engine (not shown), a core 1*b* mounted in confronting relation to the rotor, and a coil 1*c* wound around a central leg of the core. An electronic circuit unit 2, which is separate from the signal generator unit 1, comprises a capacitor 2*a* connected in parallel with the coil 1*c* to form a resonant circuit, a supply circuit 2*b* for delivering oscillation energy to the resonant circuit, a threshold detector 2*c* for monitoring the oscillation condition of the resonant circuit, an amplifier 2*d* for amplifying the detector output, a power transistor 2*e* (Darlington pair) driven by the amplifier output, and a power supply circuit 2*f*. An ignition coil 3 includes primary and secondary windings 3*a*, 3*b* connected to a battery 4.

Figures 2A, 2B, 2C, 2D, 2E:
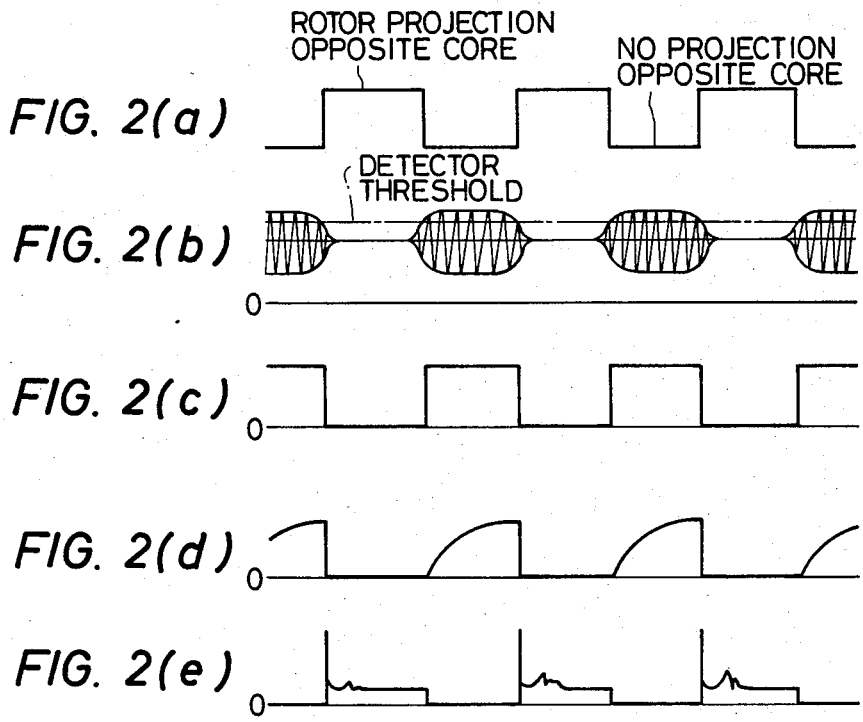
Figure 3:
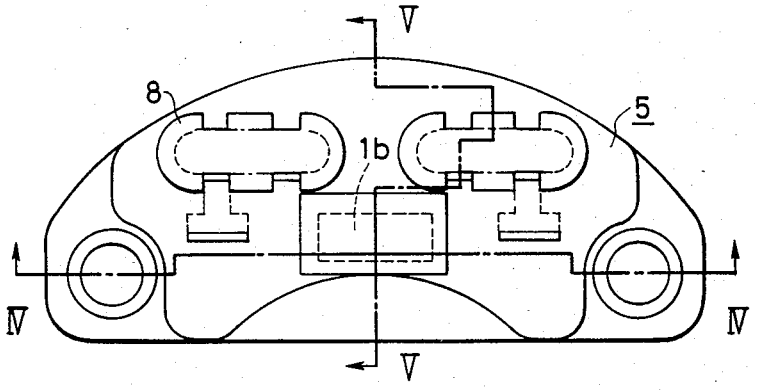
FIG. 3 shows a front elevation of an ignition system casing and mounting arrangement according to this invention.
Figure 4:
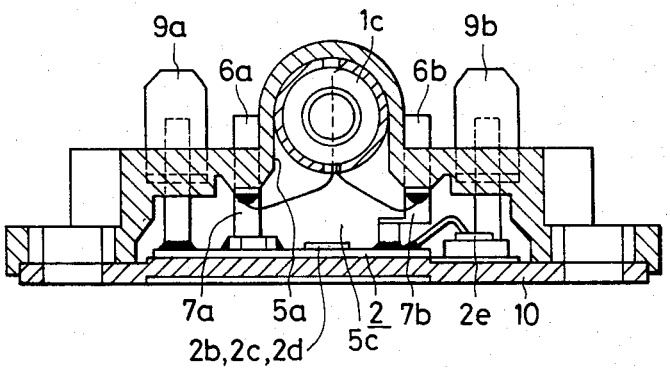
FIG. 4 shows a cross-sectional view taken along the line IV—IV of FIG. 3.
Figure 5:
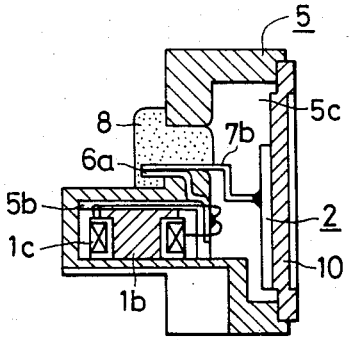
FIG. 5 shows a cross-sectional view taken along the line V—V of FIG. 3.
Figure 6:
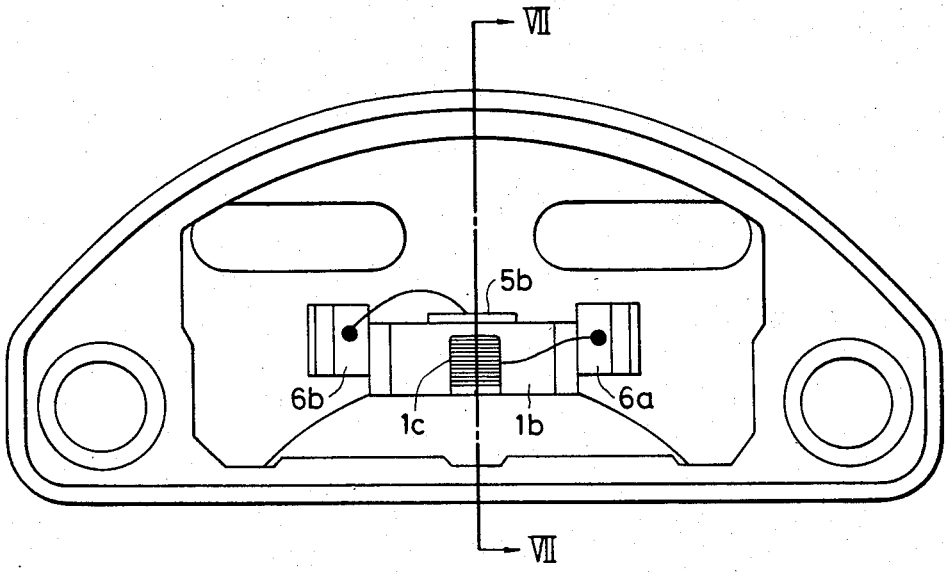
FIG. 6 shows a rear view of the casing illustrated in FIG. 3.
Figure 7:
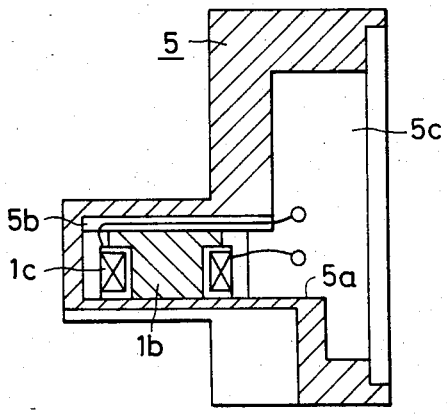
FIG. 7 shows a cross-sectional view taken along the line VII—VII of FIG. 6.

In operation, when the rotor 1*a* is driven in synchronism with the rotation of the engine, the core 1*b* confronting the rotor and magnetically permeable projections thereon move relative to each other in a pattern as generally illustrated in FIG. 2(*a*). The coil 1*c* wound around the core 1*b* and the capacitor 2*a* are interconnected, and jointly constitute a resonant circuit as mentioned above.

The resonant circuit is supplied with oscillation energy from the circuit 2*b*. When a rotor projection does not lie opposite the core 1*b*, the resonant circuit oscillates to produce a waveform as shown in FIG. 2(*b*) whose amplitude is such that the energy loss in the resonant circuit is counterbalanced by or equal to the energy supplied from the circuit 2*b*. When a rotor projection is disposed opposite the core, on the other hand, substantial magnetic flux is coupled into the rotor and the oscillation signal becomes extinguished due to eddy current and hysteresis losses.

When the amplitude of the oscillation signal exceeds the threshold level shown in FIG. 2(*b*) the detector 2*c* produces a raised output as shown in FIG. 2(*c*) which, after amplification, is applied to transistor 2*e* as a switching signal. When the transistor is conductive an electrical current builds up in the primary winding 3*a* of the ignition coil as shown in FIG. 2(*d*). When this current flow is terminated in response to the oscillation signal falling below the detector threshold, a high voltage spike is generated in the secondary winding 3*b* of the ignition coil as shown in FIG. 2(*e*), which is applied as a firing pulse to an associated spark plug.

In a conventional ignition system of this type the signal generator unit 1 and the electronic circuit unit 2 are typically interconnected by relatively long lead wires. Since the resonant oscillation signal as shown in FIG. 2(*b*) has a high frequency to enable more rapid ignition response, unwanted radio frequency interference signals tend to be radiated from such long interconnecting lead wires, and such signals may induce false ignition pulses which result in the malfunction of the system. In addition, the junctions where the various components are connected together are not mechanically reliable over extended periods of use.

These disadvantages are effectively overcome according to the present invention by the ignition system casing and housing arrangement illustrated in FIGS. 3 through 7, to which reference will now be made. As may be seen therein, the coil 1*c* is wound around a central leg of the annular core 1*b*, and the electronic unit 2 is provided in integrated circuit form and is mounted on a heat sink 10. A frame 5 is open at one end, and together with the heat sink constitutes an ignition unit casing. The frame 5 comprises a first housing 5*a* in which the core 1*b* is disposed and a slot 5*b* through which lead wires from the coil extend, and a second housing 5*c* accommodating the electronic circuit unit 2 and communicating with the first housing. The lead wires of the coil are connected to respective terminal plates 6*a*, 6*b* within the casing, and these are in turn connected to the electronic circuit unit 2 by junction leads or straps 7*a*, 7*b*. Insulatory sealing grommets 8 are press-fitted into the frame 5 and cover the junction leads. Connector posts 9*a*, 9*b* are mounted on the frame 5 to provide external connections for the circuit unit 2.

An ignition system constructed as described above will operate in the same manner as that of the prior art system. The coil 1*c* and the electronic circuit unit 2 are disposed as a unitary assembly within the casing, however, and thus the lead wires of the coil are quite short in length. As a result substantially no unwanted radiowaves are radiated by such lead wires, and no high voltage ignition pulses are induced in them. The ignition system is thus free from the malfunctions which would otherwise be caused by such shortcomings, and the various electrical and structural junctions are considerably more reliable mechanically.

What is claimed is:

1. An ignition system for an internal combustion engine, comprising: a signal rotor (1*a*) driven in synchronism with an internal combustion engine, a core (1*b*) disposed in confronting relation to said rotor and having a coil (1*c*) wound therearound, a capacitor (2*a*) connected to said coil to form a resonant circuit therewith, a supply circuit (2*b*) for supplying said resonant circuit with oscillation energy, a threshold detector circuit (2*c*) for detecting the condition of oscillation of said resonant circuit, an amplifier (2*d*) for amplifying an output signal from said detector circuit, a switching element (2*e*) driven by an output signal from said amplifier, an ignition coil (3) for generating a high voltage in response to intermittent operation of said switching element, and a single casing having an open end, said casing including a first housing portion (5*a*) accommodating said core and coil, and a second housing portion (5*c*) communicating with said first housing portion and accommodating an electronic circuit unit (2) including said capacitor, oscillation energy supply circuit, oscillation detector circuit, amplifier and switching element.

2. An ignition system as defined in claim 1, wherein said casing comprising a frame (5) and a heat sink (10) mounted thereon, and said electronic circuit unit is mounted on said heat sink.

3. An ignition system as defined in claims 1 or 2, wherein the open end of said casing defines a circular aperture configured to accommodate said rotor, and said core is mounted closely adjacent said aperture.

4. An ignition system as defined in claim 3, wherein electrical connections between said coil and capacitor comprise terminal plates and junction straps.

5. An ignition system as defined in claim 2, wherein said casing further includes sealing means for sealing said casing.

6. An ignition system as defined in claim 5, wherein said sealing means comprises sealing grommets (8).

* * * * *